US009646535B2

(12) United States Patent
Yoon et al.

(10) Patent No.: US 9,646,535 B2
(45) Date of Patent: May 9, 2017

(54) ORGANIC LIGHT EMITTING DISPLAY DEVICE

(71) Applicant: LG DISPLAY CO., LTD., Seoul (KR)

(72) Inventors: Sungwook Yoon, Goyang-si (KR); Youngju Park, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 51 days.

(21) Appl. No.: 14/937,460

(22) Filed: Nov. 10, 2015

(65) Prior Publication Data

US 2016/0133185 A1 May 12, 2016

(30) Foreign Application Priority Data

Nov. 10, 2014 (KR) ..... 10-2014-0155204

(51) Int. Cl.
*G09G 3/3233* (2016.01)

(52) U.S. Cl.
CPC ... *G09G 3/3233* (2013.01); *G09G 2300/0842* (2013.01); *G09G 2300/0861* (2013.01); *G09G 2310/0262* (2013.01); *G09G 2310/0286* (2013.01); *G09G 2320/045* (2013.01)

(58) Field of Classification Search
CPC ... G09G 2310/0262; G09G 2310/0286; G09G 2320/045; G09G 2300/0842; G09G 3/3233
See application file for complete search history.

(56) References Cited

U.S. PATENT DOCUMENTS

| | | | | |
|---|---|---|---|---|
| 9,454,935 | B2 * | 9/2016 | Park | G09G 3/3233 |
| 9,508,780 | B2 * | 11/2016 | Tanikame | G09G 3/3233 |
| 2010/0220093 | A1 * | 9/2010 | Choi | G09G 3/3233 345/213 |

* cited by examiner

*Primary Examiner* — Gerald Johnson
(74) *Attorney, Agent, or Firm* — Birch, Stewart, Kolasch & Birch, LLP

(57) ABSTRACT

An organic light emitting display device according to an embodiment includes a display panel including n (n is a natural number) number of horizontal lines, an ith (i is a natural number satisfying a condition of 1<i<n−2) scan signal generating unit and an ith emission control signal generating unit. The ith scan signal generating unit generates an ith scan signal and provides the generated ith scan signal to an ith horizontal line and an (i+2)th horizontal line. The ith emission control signal generating unit generates an ith emission control signal to be provided to the ith horizontal line.

6 Claims, 8 Drawing Sheets

ORGANIC LIGHT EMITTING DISPLAY DEVICE

This application claims the priority benefit of Korean Patent Application No. 10-2014-0155204 filed on Nov. 10, 2014, the entire contents of which is incorporated herein by reference for all purposes as if fully set forth herein.

BACKGROUND OF THE INVENTION

Field of the Invention

The present disclosure relates to an organic light emitting display device.

Discussion of the Related Art

Due to advantages of compactness and light weight, flat panel displays (FPDs) have been widely used in portable computers or portable cellular terminals such as notebook computers, personal digital assistants (PDAs), as well as in monitors of desktop computers. FPDs include a liquid crystal display (LDD), a plasma display panel (PDP), a field emission display (FED), and an organic light emitting display device.

Among the FPDs, an organic light emitting display device has a fast response speed, expresses brightness with high luminous efficiency, and has a wide viewing angle. In general, in an organic light emitting display device, a data voltage is applied to a gate electrode of a driving transistor using a switching transistor turned on by a scan signal, and an organic light emitting diode (OLED) emits light using the data voltage supplied to the driving transistor. That is, a current supplied to the OLED is adjusted by the data voltage applied to the gate electrode of the driving transistor. Here, however, driving transistors respectively formed in pixels have threshold voltages Vth with variations. Due to the variations of the threshold voltages of the driving transistors, a current value different from a designed value may be supplied to the OLED, and thus, brightness may be different from a desired value.

In order to compensate for the variation of the threshold voltage of a driving transistor, various methods have been proposed. One of these methods is compensating for the variation of the threshold voltage of a driving transistor using a sampling operation of saturating a gate-source potential of the driving transistor with a threshold voltage.

As for the sampling operation, it is important to secure a sufficient time to saturate the gate-source potential of the driving transistor with the threshold voltage. However, since a horizontal period for scanning one horizontal line is shortened as the resolution of a display panel is increased, it is not easy to secure the sampling period.

SUMMARY OF THE INVENTION

In an aspect of the present disclosure, an organic light emitting display device includes a display panel including n (n is a natural number) number of horizontal lines, an ith (i is a natural number satisfying a condition of $1 \leq i \leq n-2$) scan signal generating unit, and an ith emission control signal generating unit. The ith scan signal generating unit may generate an ith scan signal and provides the generated ith scan signal to an ith horizontal line and an (i+2)th horizontal line. The ith emission control signal generating unit may generate an ith emission control signal provided to an ith horizontal line. The ith scan signal generating unit may output an ith scan signal within a scan period from a (i−2)th horizontal line to an ith horizontal line. The ith emission control signal generating unit may output an ith emission control signal synchronized with an ith scan signal within a (i−1)th horizontal line and synchronized with the ith scan signal during a partial section within a scan period of an ith horizontal line.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Figure 1:
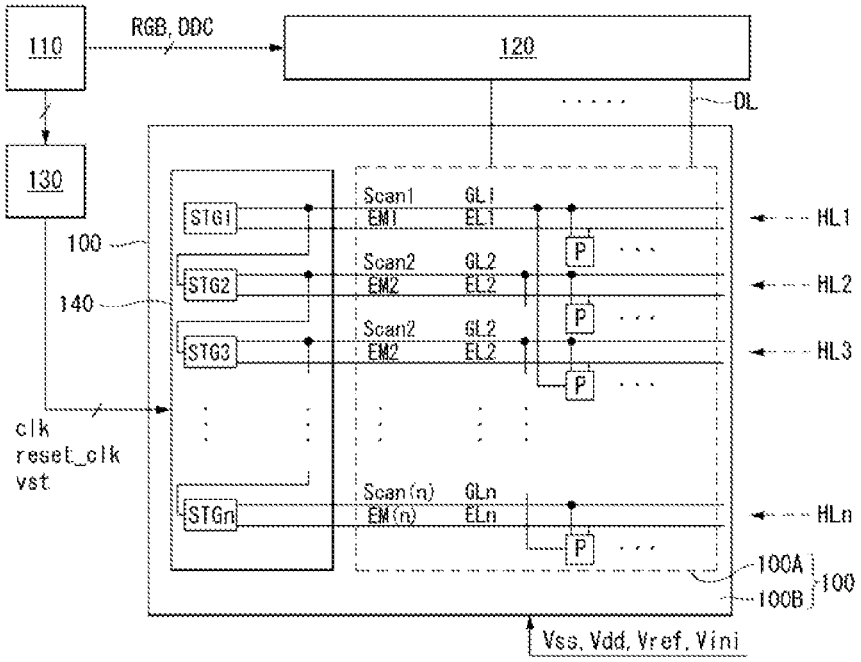
FIG. 1 is a view illustrating an organic light emitting display device according to an embodiment of the present disclosure.

FIG. 1 is a view illustrating an organic light emitting display device according to an embodiment of the present disclosure.

Referring to FIG. 1, an organic light emitting display device according to an embodiment of the present disclosure includes a display panel 100 in which pixels P are arranged in a matrix form, a data driver 120, gate drivers 130 and 140, and a timing controller 110. All the components of the organic light emitting display device according to all embodiments are operatively coupled and configured.

The display panel 100 includes a plurality of pixels P and displays an image on the basis gray levels represented by the pixels P. A plurality of pixels P are arranged at a predetermined interval in each of first to nth horizontal lines HL1 to HL[n], thus being disposed in a matrix form within the display panel 10.

The pixels P are disposed in regions where data line units DL and n number of gate line units GL intersect with each other. The data line units connected to the pixels P include an initialization line 14*a* and a data line 14*b*, and the gate line units GL include a previous stage scan line 15*a*, a current stage scan line 15*b*, and an emission control line 15*c*.

Each of the pixels P includes an organic light emitting diode (OLED), a driving transistor DT, first to third transistors T1, T2, and T3, a storage capacitor Cst, and a sub-capacitor Csub. The driving transistor DT and the first to third transistors T1, T2, and T3 may be implemented as oxide thin film transistors (TFTs) including an oxide semiconductor layer. The oxide TFTs are advantages to an increase in an area of the display panel 100 in consideration of all of electron mobility, process variations, and the like. However, the present disclosure is not limited thereto and semiconductor layers of the TFTs may be formed of amorphous silicon or polysilicon.

The timing controller 110 serves to control driving timing of the data driver 120 and the gate drivers 130 and 140. To this end, the timing controller 110 may realigns digital video data RGB input from the outside according to resolution of the display panel 100 and supplies the realigned digital video data to the data driver 120. Also, the timing controller 110 generates a data control signal DDC for controlling an operation timing of the data driver 120 and a gate control signal GDC for controlling an operation timing of the gate drivers 130 and 140, on the basis of timing signals such as a vertical synchronization signal Vsync, a horizontal synchronization signal Hsync, a dot clock signal DCLK, and a data enable signal DE.

The data driver 120 serves to drive the data line units DL. To this end, the data driver 120 converts digital video data RGG input from the timing controller 110 into an analog data voltage on the basis of a data control signal DDC, and supplies the converted analog data voltage to the data lines 14*b*. Also, the data driver 120 provides an initialization voltage Vini to the pixels P through an initialization line 14*a*.

The scan drivers 130 and 140 include a level shifter 130 and a shift register 140. In the scan driver 130, the level shifter 130 and the shift register 140 are differentiated, and the shift register 140 is formed in a gate-in-panel (GIP) type formed in a non-display area 100B of the display panel 100.

The level shifter 130 is formed as an integrated circuit (IC) on a printed circuit board (PCB) (not shown) connected to the display panel 100. The level shifter 130 level-shifts clock signals CLK and a start signal VST and supplies the level-shifted signals to the shift register 140 under the control of the timing controller 11. The shift register 140 is formed as a combination of a plurality of TFTs in the non-display area 100B of the display panel 100 according to the GIP scheme. The shift register 140 includes stages that shift and output a scan signal to correspond to the clock signals CLK and the start signal VST. The stages included in the shift register 140 sequentially output a scan signal and an emission control signal EM through output terminals.

Figure 2:
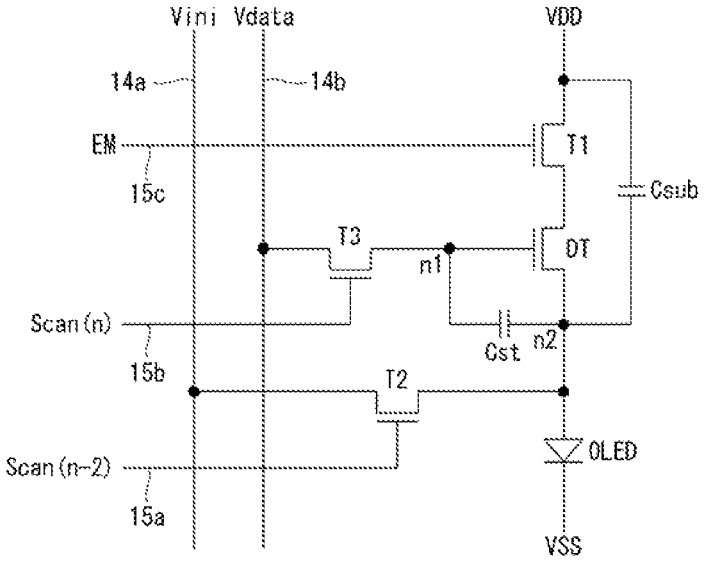
FIG. 2 is a view illustrating an example of a pixel included in an organic light emitting display device according to an embodiment of the present disclosure.

FIG. 2 is a view illustrating an example of the pixel P illustrated in FIG. 1, in which one of pixels P of the nth horizontal line is illustrated.

Referring to FIG. 2, the pixel P according to an embodiment of the present disclosure includes an OLED, a driving transistor DT, first to third transistors T1 to T3, a storage capacitor Cst, and a sub-capacitor Csub.

The OLED emits light by a driving current supplied from the driving transistor DT. A plurality of organic compound layers are formed between an anode electrode and a cathode electrode of the OLED. The organic compound layers include a hole injection layer (HIL), a hole transport layer (HTL), an emission layer (EML), an electron transport layer (ETL), and an electron injection layer (EIL). The anode electrode of the OLED is connected to a source electrode of the driving transistor DT, and a cathode electrode thereof is connected to a ground terminal VSS.

The driving transistor DT controls a driving current applied to the OLED by a voltage between a gate and a source thereof. To this end, the gate electrode of the driving transistor DT is connected to an input terminal of a data voltage Vdata, a drain electrode thereof is connected to an input terminal of a driving voltage VDD, and a source electrode thereof is connected to a low driving voltage VSS.

In response to the emission control signal EM, the first transistor T1 controls a current path between the driving voltage VDD input terminal and the driving transistor DT. To this end, a gate electrode of the first transistor T1 is connected to the emission control signal line 15*c*, a drain electrode thereof is connected to the driving voltage VDD input terminal, and a source electrode thereof is connected to the driving transistor DT.

In response to a (n−1)th scan signal (Scan(n−1)), the second transistor T2 provides the initialization voltage Vini provided from the initialization line 14*a* to a second node n2. To this end, a gate electrode of the second transistor T2 is connected to a (n−1)th scan line 15*a*, a drain electrode thereof is connected to the initialization line 14*a*, and a source electrode is connected to a second node n2.

In response to an nth scan signal (Scan(n)), the third transistor T3 provides a reference voltage Vref and a data voltage Vdata provided from the data line 14*c* to the driving transistor DT. To this end, a gate electrode of the third transistor T3 is connected to the nth scan line (Scan (n)), a drain electrode thereof is connected to the data line 14*c*, and a source electrode thereof is connected to the driving transistor DT.

The storage capacitor Cst maintains the data voltage Vdata provided from the data line 14*c* during one frame to enable the driving transistor DT to maintain a constant voltage. To this end, the storage capacitor Cst is connected to the gate electrode and the source electrode of the driving transistor DT.

The sub-capacitor C1 is connected to the storage capacitor Cst in series at the second node n2 to serve to increase efficiency of the driving voltage Vdata.

Figure 3:
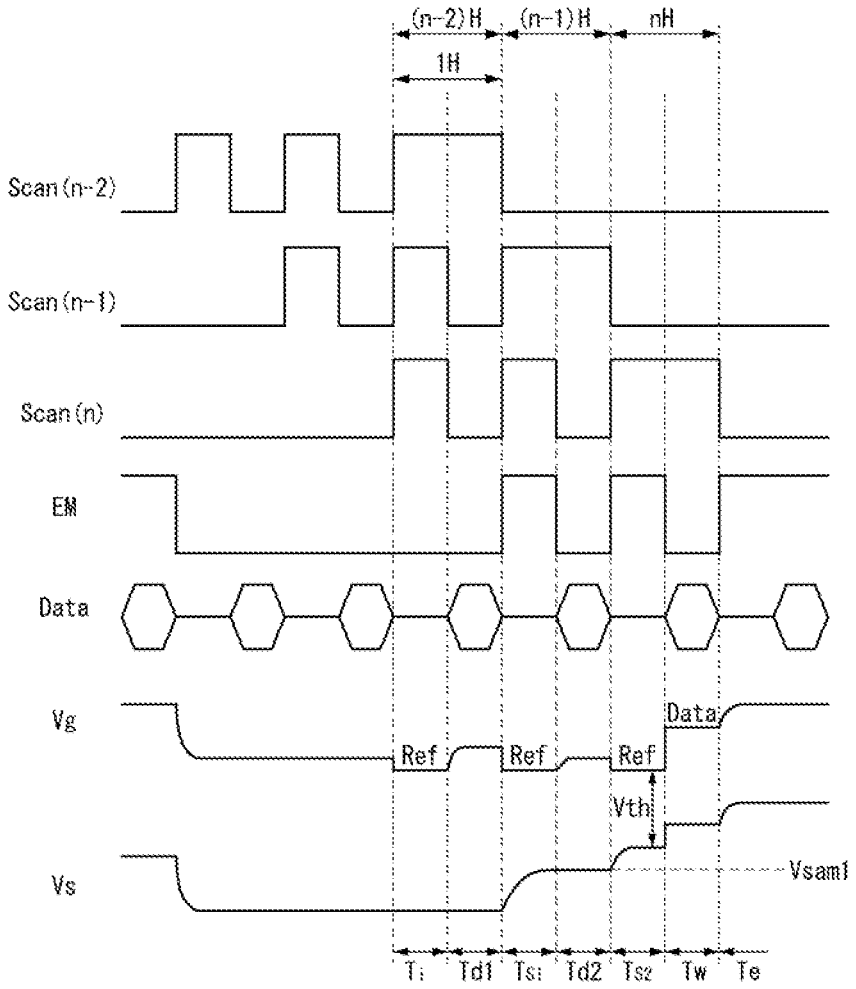
FIG. 3 is a timing diagram for driving an organic light emitting display device according to an embodiment of the present disclosure.

An operation of the pixel P having the aforementioned structure is as follows. FIG. 3 is a waveform view illustrating signals EM, SCAN, INIT, and DATA applied to the pixel P of FIG. 2, and changes in potentials of the gate electrode and the source electrode of the driving transistor DT.

In FIG. 3, a horizontal period H refers to a scan period of pixels P arranged in one horizontal line HL. The scan period includes a data write period and a second sampling period for detecting a threshold voltage of the driving transistor. For example, an nth horizontal period (n)H is a scan period of an nth horizontal line HLn, a (n−1)th horizontal period refers to a scan period of an (n−1)th horizontal line as a horizontal line of a previous stage, and (n−2)th horizontal period (n−2)H is a scan period of an (n−2)th horizontal line as the one before the previous stage. One (1) horizontal period 1H includes secondary sampling period Ts2 and a data write period Tw of driving transistors DT arranged in one horizontal line HL.

FIGS. 4*a* through 4*e* illustrate equivalent circuits of the pixel P in an initialization period Ti, a sampling period Ts, a data write period Tw, and an emission period Te. Here, in FIGS. 4*a* through 4*e*, activated elements are indicated by the solid line and deactivated elements are indicated by the dotted lines.

An operation of the pixel P according to an embodiment of the present disclosure includes an initialization period Ti for initializing nodes A, B, and C by a specific voltage, first and second sampling periods Ts1 and Ts2 for detecting and storing a threshold voltage of the driving transistor DT, a writing period Tw for applying the data voltage Vdata, and the emission period Te for emitting light by compensating a driving current applied to the OLED using a threshold voltage and a data voltage Vdata, irrespective of the threshold voltage.

A scan period of the nth horizontal line HLn is performed during an nth horizontal period nH. The initialization period of the nth horizontal line nH overlaps a first sampling period of an (n−1)th horizontal line and a second sampling period of an (n−2)th horizontal line. That is, the initialization period of pixels of the nth horizontal line nH and the first sampling period are performed at an interval other than the scan period. Thus, in the present disclosure, a time for writing data in one horizontal line may be sufficiently secured. Also, the sampling period for compensating for the threshold voltage of the driving transistor includes first and second sampling periods, and since the first sampling period is performed before the scan period, a wide sampling period may be secured without reducing a data write time.

A driving method of the present disclosure will be described in detail as follows.

Figure 4A:
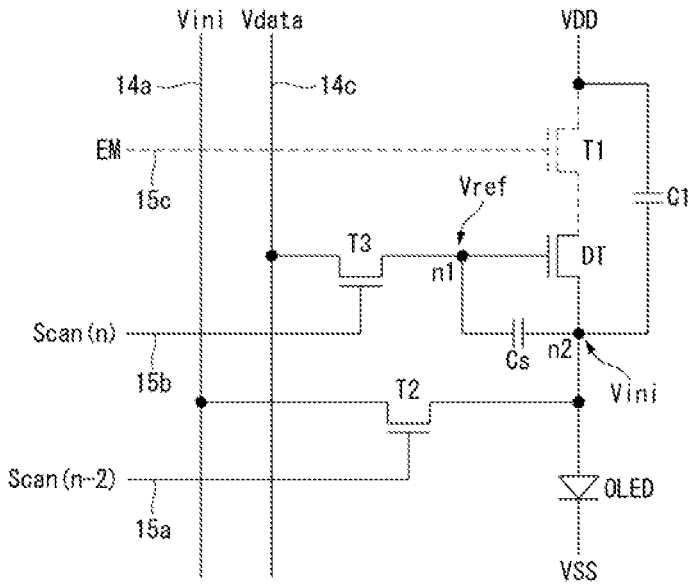
FIGS. 4*a* through 4*e* are views illustrating a method for driving an organic light emitting display device according to an embodiment of the present disclosure.

Referring to FIGS. 3 and 4*a*, the initialization period T1 regarding the nth horizontal line is performed in the (n−2)th horizontal period (n−2)H.

During the initialization period Ti, the second transistor T2, in response to the (n−1)th scan signal Scan(n−1), supplies the initialization voltage Vini provided from the initialization line 14*a* to the second node n2. Thus, a source voltage Vs of the driving transistor DT, a voltage of the second node n2, has a potential of the initialization voltage Vini. The third transistor T3, in response to the nth scan signal Scan(n), supplies a reference voltage Vref provided from the data line 14*c* to the first node n1 of the gate electrode of the driving transistor DT. Thus, the gate voltage Vg of the driving transistor DT as a voltage of the first node n1 has a potential of the reference voltage Vref.

The initialization voltage Vini supplied to the second node n2 during the initialization period T is to initialize the pixel P to a predetermined level, and here, a magnitude of the initialization voltage Vini is set to a value smaller than that of an operation voltage of the OLED such that the OLED may not emit light. For example, the initialization voltage Vini may be set to have a voltage having a magnitude ranging from −1 to +1 (V).

The (n−2)th horizontal period (n−2)H includes a write period for driving pixels of the (n−2)th horizontal line, and thus, the initialization period Ti may be performed within a time of 40% to 60% of the first horizontal period 1H, for example, within a H time range.

During a first transition period Td1, a voltage of the first node n1 is maintained at the reference voltage Vref, and a voltage of the second node n2 is maintained at the initialization voltage Vini.

Figure 4B:
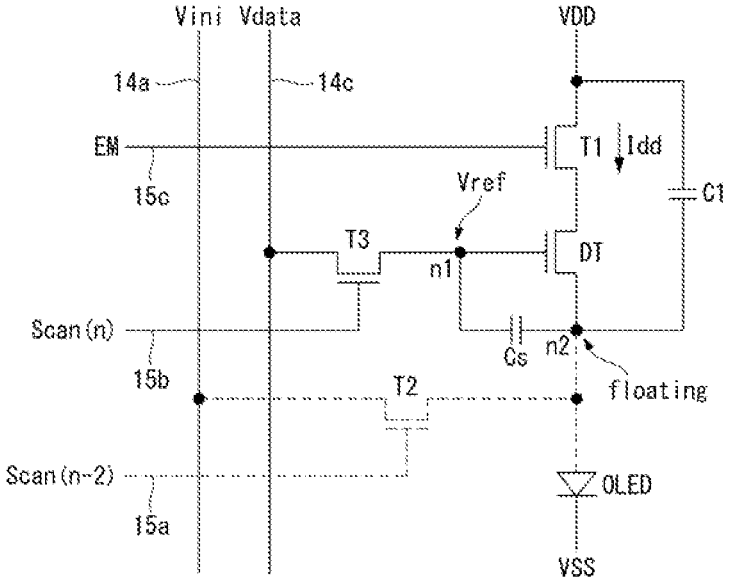

Referring to FIGS. 3 and 4*b*, a first sampling period Ts1 regarding the nth horizontal line is performed in the (n−1)th horizontal period (n−1)H.

Here, the third transistor T3, in response to the nth scan signal Scan(n), supplies the reference voltage Vref provided from the data line 14C to the first node n1. Also, the first transistor T1, in response to the emission control signal EM, supplies the driving voltage VDD to the driving transistor DT. Here, a gate electrode voltage Vg of the driving transistor is maintained at the reference voltage Vref. As the second node n2 is in a floated state, current flowing through the first transistor T1 and the driving transistor DT is accumulated, so the voltage of the second node n2 is increased from the initialization voltage to a first sampling voltage Vsam1.

The (n−1) horizontal period is a period including application of a data voltage at the scan period of a previous stage, and thus, the first sampling period Ts1 may be performed within a time of 40% to 60% of 1 horizontal period 1H, for example, within a ½H time range. In this manner, during the ½H time, a first sampling period, a voltage is gradually increased from the initialization voltage Vini at the second node n2.

Thereafter, during the second transition period Td2, the first to third transistors T1,T2, and T3 are turned off, the reference voltage Vref is maintained at the first node n1, and the voltage accumulated during the first sampling period Ts1 is maintained at the second node n2.

Figure 4C:
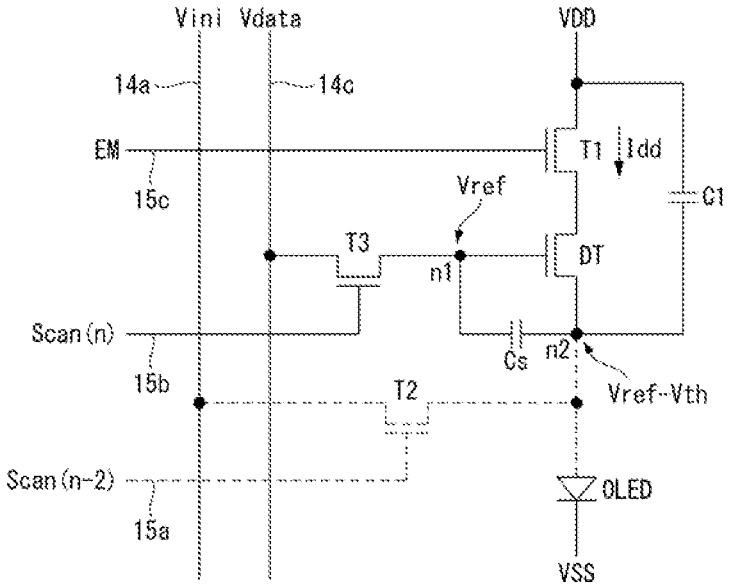

Referring to FIGS. 3 and 4*c*, the second sampling period Ts2 with respect to nth horizontal line is performed at a horizontal period (n)H of the current stage.

During a second sampling period Ts2, the third transistor T3 supplies a reference voltage Vref provided from the data line 14*c* to the first node n1 in response to an nth scan signal Scan(n). The first transistor T1 supplies a driving voltage VDD to the driving transistor DT in response to an emission control signal EM.

Here, a gate electrode voltage Vg of the driving transistor maintains the reference voltage Vref. Since the second node n2 is in a floating state, current flowing through the first transistor T1 and the driving transistor DT when the voltage of the second node n2 is at the voltage of the second node n2 is accumulated, so the voltage is increased again from the voltage increased during the first sampling period. The voltage increased through the sampling period Ts2 is saturated as a voltage having a magnitude corresponding to a difference between the reference voltage Vref and the threshold voltage Vth of the driving transistor DT. That is, through the sampling periods Ts1 and Ts2, a potential difference between the gate and source of the driving transistor DT is equal to a magnitude of the threshold voltage Vth.

That is, potentials accumulated in the source electrode of the driving transistor DT during the second sampling period Ts2 is accumulated through the first and second sampling periods Ts1 and Ts2 performed during two times of scan periods of the horizontal period H, that is, scan periods of a previous stage horizontal period and a current stage horizontal period. In this manner, in the present invention, the threshold voltage is detected with a sufficient temporal leeway, a degradation of image quality due to variations of threshold voltages may be effectively improved.

Figure 4D:
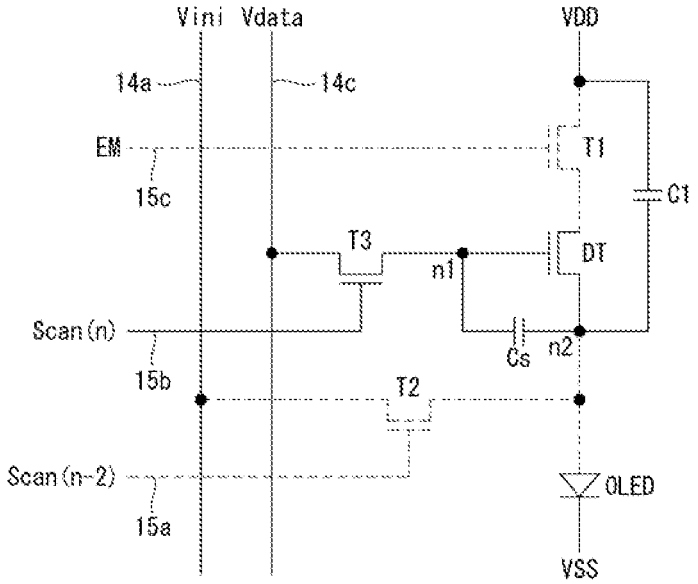

Referring to FIGS. 3 and 4*d*, a write period Tw with respect to the current stage horizontal line is performed at the current stage horizontal period (n)H.

During the write period Tw, the first and second transistors T1 and T2 are turned off. The third transistor T3 is turned on to receive a data voltage Vdata provided from the data line 14*c* and supply the received data voltage Vdata to the first node n1. Here, the second node n2 voltage in a floating state is coupled according to a ratio of the storage capacitor Cst and the sub-capacitor Ca so as to rise or fall.

Figure 4E:
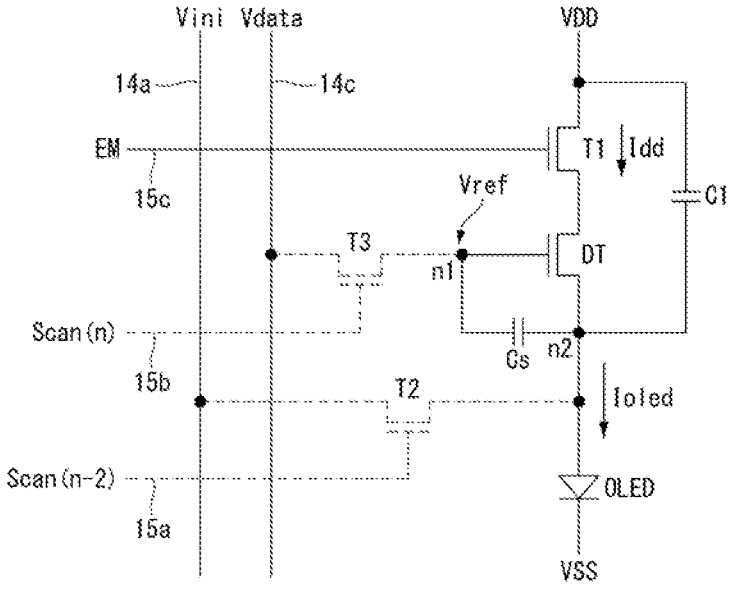

Referring to FIGS. 3 and 4*e*, an emission period Te with respect to the nth horizontal line is performed in an nth horizontal period (n)H.

During the emission period Te, the second and third transistors T2 and T3 are turned off and the first transistor is turned on. Here, the data voltage Vdata stored in the storage capacitor Cst is supplied to the OLED, and accordingly, the OLED emits light with brightness in proportion to the data voltage Vdata. Here, a current flows in the driving transistor DT by a voltage of the first node n1 and the second node n2 determined during the write period Tw, and thus, a desired current is supplied to the OLED, and accordingly, the OLED may adjust brightness by the data voltage Vdata.

Figure 5:
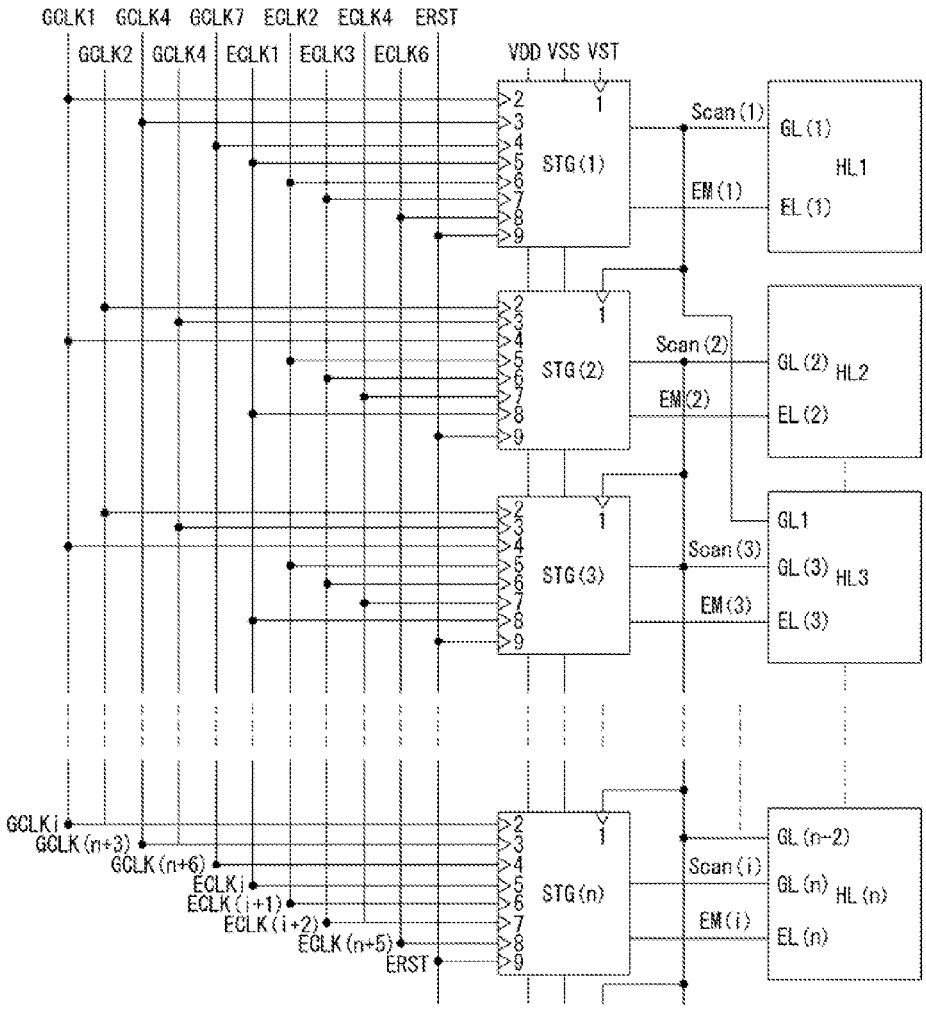
FIG. 5 is a view illustrating a connection relationship of a shift register according to an embodiment of the present disclosure.
Figure 6:
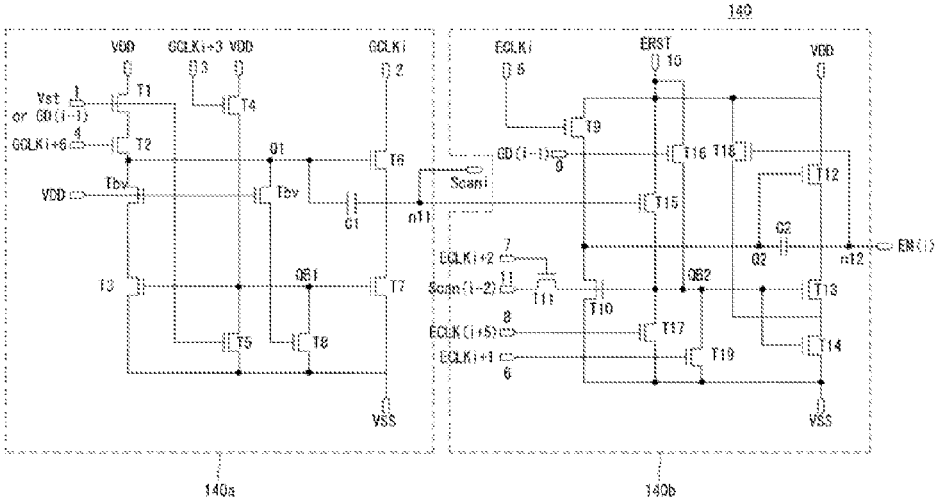
FIG. 6 is a circuit diagram illustrating a stage of a shift register according to an embodiment of the present disclosure.

FIG. 5 is a block diagram of a shift register according to an embodiment of the present invention and FIG. 6 is a circuit diagram of an ith stage according to an embodiment of the present invention.

Referring to FIG. 5, the shift register 140 according to an embodiment of the present invention includes a plurality of stages STG(1) to STG(i). Each of the stages STG[1] to STG[n] output a scan signal and an emission control signal EM by using 7-phase gate clocks GCLK1 to GCLK7, 7-phase emission clocks ECLK1 to ECLK7, a low potential voltage, and a start signal VST.

Each of the stages STG[1] to STG[n] includes first to $11^{th}$ terminals 1 to 11. The first terminal 1 receives the start signal VST. The second terminal 2 receives an ith gate clock GCLKi, the third terminal 3 receives an (i+3)th gate clock GCLK[i+3], and a fourth terminal 4 receives an (i+6)th gate clock GCLK[i+6]. The fifth terminal 5 receives ith emission clock ECLKi, the sixth terminal 6 receives (i+1)th emission clock ECLK[i+1], the seventh terminal 7 receives an (i+2)th emission clock ECLK[i+2], and an eighth terminal 8 receives an (i+5)th emission clock ECLK[i+5]. The ninth terminal 9 receives (i−1)th scan signal Scan[i−1]. The tenth terminal 10 receives an emission reset ERST. In addition, each of the stages STG[i] to STG[n] includes input terminals receiving a high potential voltage VDD and a low potential voltage VSS.

As illustrated in FIG. 6, each of the stages STG[i] to STG[n] includes a scan signal generating unit 140*a* and an emission control signal generating unit 140*b*.

The scan signal generating unit 140*a* of the ith stage STG[i] starts to operate on the basis of the start signal VST or the (i−2)th scan signal Scan[i−2] input to the first terminal 1, and generates an ith scan signal Scani on the basis of a timing of an ith gate clock GCLKi, a (i+3)th gate clock GCLK[i+3], and an (i+t)th gate clock GCLK[i+6]. The ith scan signal Scani is provided to the nth scan line 15*b* of the pixels P arranged at the ith horizontal line HLi, and the (n−2)th scan line 15*a* of pixels P arranged at the (i+2)th horizontal line HL[i+2].

The ith gate clock GCLKi input to the ith stage STG[i] determines an output period of the ith scan signal Scani. The (i+3)th gate clock GCLK[i+3] determines an end point of the ith scan signal Scani. The (i+6)th gate clock GCLK[i+6] performs an operation of charging a first Q node Q before output of the ith scan signal Scani.

The emission control signal generating unit 140*b* of the ith stage STG[i] generates an ith emission control signal EMI by using ith to (i−1)th scan signal Scani and Scan[i−1], an ith emission clock ECLKi, an (i+2)th emission clock ECLK[i+2], an (i+1)th emission clock ECLK[i+1], and (i+5)th emission clock ECLK[i+5].

The ith emission clock ECLKi input to the ith stage STG[i] determines an output timing of the ith emission control signal Emi. The (i+2)th emission clock ECLK[i+2] determines an end time point of the emission control signal EM which was output to a previous frame. The (i+1)th emission clock ECLK[i+1] and the (i+5)th emission clock ECLK[i+5] controls the ith emission control signal EMi to maintain a high level.

In an embodiment of the present invention, the gate clock GCLK and the emission clock ECLK are implemented to have 7 phases, and each clock signal is continuous. Thus, as a clock signal in which (i+k) (k is a natural number and 1<k<5) is greater than 7, a clock signal of a 7 subtracted ordinary is used. For example, the (i+4)th gate clock GCLK (i+4) corresponds to the second gate clock GCLK2 in the fifth stage STG5.

Based on this, the scan signal generating unit 140*a* of the first stage STG1 outputs a first scan signal Scan1 by using a start signal VST, a first gate clock GCLK1, a third gate clock GCLK3, and a fifth gate clock GCLK5. Also, the emission control signal generating unit 140*b* of the first stage STG1 outputs a first emission control signal EM1 by using a first scan signal Scan1, a first emission clock ECLK1, a second emission clock ECLK2, a third emission clock ECLK3, and a sixth emission clock ECLK6. Also, the emission control signal generating unit 140*b* of the first stage STG1 initializes the first emission control signal EM1 by using an emission reset ERST.

The plurality of stages STG[1]~STG[i] are dependently connected such that a scan signal output from an output terminal of a front stage is used by a rear stage. For example, a scan signal G[i] output from an ith stage STG[i] is supplied to the first terminal 1 as a start signal input terminal of the (i+1)th stage STG[i+1].

A circuit configuration of the ith stage STG[i] will be described with reference to FIG. 6. In FIG. 6, auxiliary transistors Tbv maintained at the turned-on state all the time by a high potential voltage VDD serve to stabilize the circuit, and since the auxiliary transistors Tbv maintain the turned-on stage all the time, it will be regarded that the auxiliary transistors Tbv are in a short state by equivalent circuit.

The scan signal generating unit 140*a* of the ith stage STG[i] includes first to eighth transistors T1 to T8.

The first electrode of the first transistor T1 is connected to the high potential voltage source VDD, a second electrode thereof is connected to a first electrode of the second transistor T2, and a gate electrode thereof is connected to a start signal input terminal 1. A second electrode of the second transistor T2 is connected to a first Q node Q1, and a gate electrode thereof is connected to a seventh gate clock input terminal 4. Since the first and second transistors T1 and T2 are connected in series, when the first and second transistors T1 and T2 are simultaneously turned on, they charges the high potential voltage VDD in the first Q node Q1. That is, the first and second transistors T1 and T2 charge the first Q node Q1 when the start signal VST (or (i−1)th scan signal (Scan(i−1)) and the (i+6)th gate clock GCLK (i+6) are synchronized.

A first electrode of the third transistor T103 is connected to the first Q node Q1, and a second electrode thereof is connected to the low potential voltage VSS input terminal, and a gate electrode thereof is connected to a first QB node QB1. Thus, the third transistor T3 discharges a potential of the Q node to a low potential voltage VSS to correspond to a potential of the first QB node QB1.

The fourth transistor T4 receives the high potential voltage VDD through a first electrode, a second electrode thereof is connected to the first QB node QB1, and a gate electrode thereof is connected to the (i+3)th gate clock GCLK(i+3). Thus, the fourth transistor T4 charges the first QB node QB1 in response to the (i+3)th gate clock GCLK (i+3). That is, the fourth transistor 4 discharges a scan signal output terminal n11 to output an ith scan signal Scani having a low potential level in response to the (i+3)th gate clock GCLK(i+3).

A fifth electrode of the fifth transistor T5 is connected to the first QB node QB1, a second electrode is connected to the low potential voltage VSS, and a gate electrode thereof is connected to a start signal input terminal 1. The fifth transistor T5 charges the first QB node QB1 with the low potential voltage in response to the start signal VST or the (i−1)th scan signal Scan(i+1).

A gate electrode of a first full-up transistor T6 is connected to the first Q node Q, a first electrode thereof is connected to an ith gate clock input terminal 2, and a second electrode thereof is connected to a scan signal output terminal n11. Thus, the sixth transistor T6 outputs an ith gate clock GCLKi to correspond to the potential of the first Q node Q1.

A gate electrode of a first pull-down transistor T7 is connected to the first QB node QB, the low potential voltage VSS is received through a first electrode thereof, and a second electrode thereof is connected to the scan signal output terminal n11. Thus, the seventh transistor T7 discharges a potential of the scan signal output terminal n11 to the low potential voltage VSS to correspond to the potential of the first QB node QB1.

A first electrode of the eighth transistor T8 is connected to the first QB node QB1, a second electrode thereof is connected to the low potential voltage VSS, and a gate electrode is connected to the first Q node Q1. Thus, the eighth transistor T108 discharges a potential of the first Q node Q1 to a low potential voltage to correspond to the potential of the first Q node Q1.

The emission control signal generating unit 140*b* of the ith stage STG[i] includes ninth to $19^{th}$ transistor T19.

A first electrode of the ninth transistor T9 is connected to the high potential voltage VDD, a second electrode thereof is connected to the second Q node Q2, a gate electrode thereof is connected to an input termination of an emission clock ECLKi. Thus, the ninth transistor T109 charges the second Q node Q2 in response to the ith emission clock ECLKi.

A first electrode of the tenth transistor T10 is connected to the second Q node Q2, a second electrode thereof is connected to a low potential voltage VSS, and a gate electrode is connected to the second electrode of a first low potential trigger transistor T11. Thus, when the first low potential trigger transistor T11 is turned on, the tenth transistor T10 discharges the second Q node Q2 to the low potential voltage VSS.

A first electrode of the low potential trigger transistor T11 is connected to the second QB node QB2, a second electrode thereof is connected to an (i−2)th scan signal output terminal 10, and a gate electrode thereof is connected to an (i+2)th emission clock ECLK[i+2] input terminal 7. Thus, the first electrode of the low potential trigger transistor T11 operates the tenth transistor T10 when the (i+2)th emission clock ECLK[i+2] and the (i−2)th scan signal Scan[i−2] are synchronized.

A first electrode of the $12^{th}$ transistor T12 is connected to the high potential voltage VDD, a second electrode thereof is connected to the emission control signal output terminal n12, and a gate electrode thereof is connected to the second Q node Q2. Thus, the $12^{th}$ transistor T12 outputs ith emission control signal corresponding to the high potential voltage to the emission control signal output stage n12 to correspond to the potential of the second Q node Q2.

The $13^{th}$ and $14^{th}$ transistors T13 and T14 are connected in series, and gate electrodes of the $13^{th}$ and $14^{th}$ transistors T14 are connected to the second QB node QB2, a first electrode of the $13^{th}$ transistor T13 is connected to the emission control signal output terminal n12, and a second electrode of the $14^{th}$ transistor T14 is connected to the low potential voltage VSS of the $14^{th}$ transistor T14. Thus, the $13^{th}$ and $14^{th}$ transistors T14 discharges a potential of the emission control signal output terminal n12 to a low potential voltage VSS to correspond to the potential of the second QB node QB2.

A first electrode of a third low potential trigger transistor T15 is connected to an emission reset ERST input terminal, a second electrode thereof is connected to the second QB node QB2, and a gate electrode thereof is connected to the scan signal output terminal n11. Thus, when the emission reset ERST and the ith scan signal Scani are synchronized, the third low potential trigger transistor T15 charges the second QB node QB2 to a high potential voltage VDD.

A first electrode of a second low potential trigger transistor T16 is connected to the emission reset ERST input terminal, a second electrode thereof is connected to the second QB node QB2, and a gate electrode thereof is connected to an (i−1)th scan signal Scan[i−1] output terminal. Thus, when the emission reset ERST and the (i−1)th scan signal Scan[i−1] are synchronized, the second low potential trigger transistor T16 charges the second QB node QB2.

A first electrode of the $17^{th}$ transistor T17 is connected to the second QB node QB, a second electrode is connected to the low potential voltage VSS, and a gate electrode thereof is connected to an emission clock ECLK(i+5) input terminal. A first electrode of the $19^{th}$ transistor T119 is connected to the second QB node QB2, a second electrode thereof is connected to the low potential voltage VSS, and a gate electrode thereof is connected to a sixth terminal 6 receiving the (i+1)th emission clock ECLK(i+1). Thus, the $17^{th}$ and $19^{th}$ transistors T17 and T19 charge the second QB node QB2 in response to the (i+4)th emission clock and the (i+1)th emission clock ECLK(i+1).

A first electrode of the $18^{th}$ transistor T18 is connected to the low potential voltage VDD, a second electrode thereof is connected to a second electrode of the $13^{th}$ transistor T113, and a gate electrode thereof is connected to the emission control signal output terminal n12.

Figure 7:
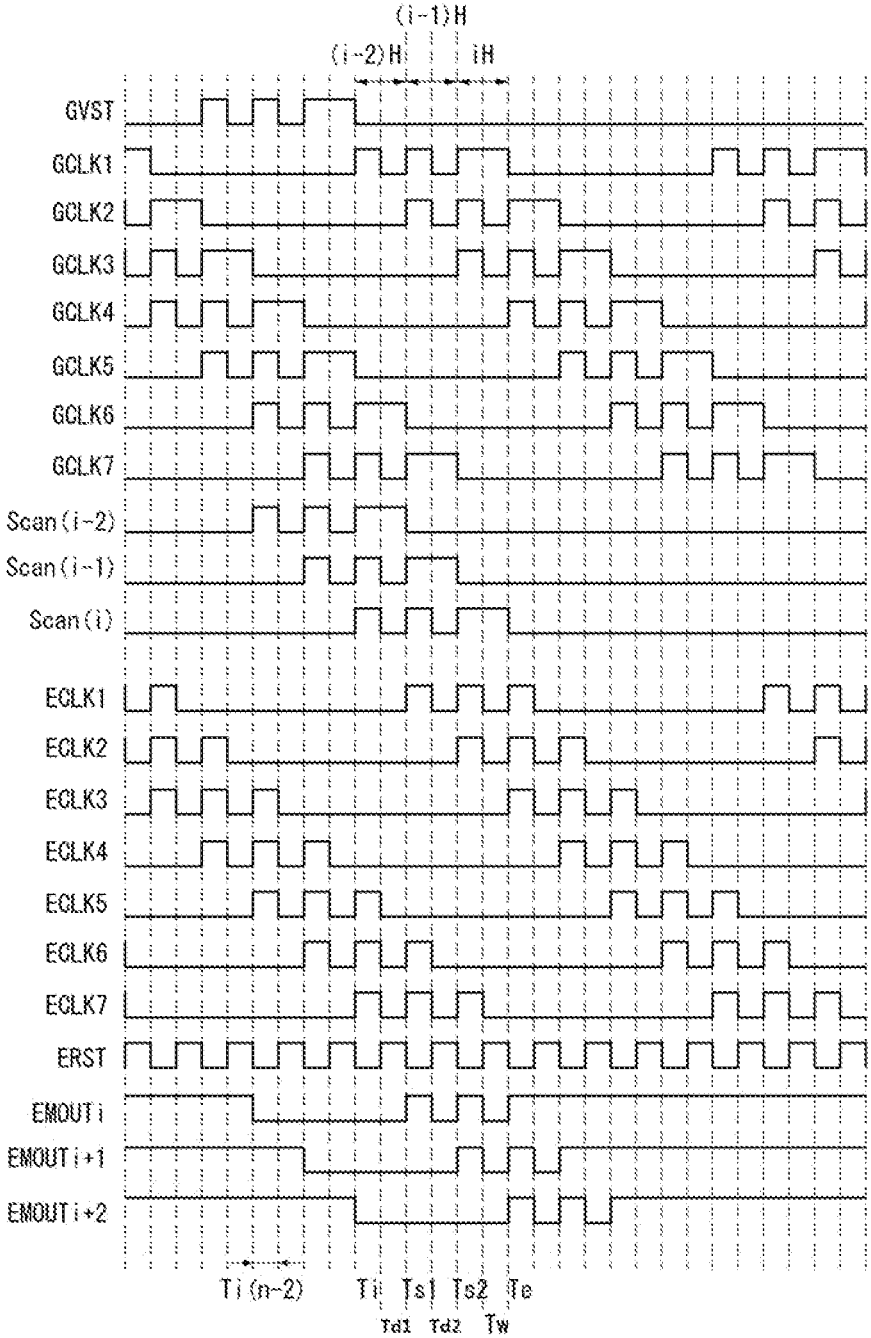
FIG. 7 is a timing diagram illustrating clock signals for driving the shift register illustrated in FIG. 6 and output signals corresponding thereto according to an embodiment of the present disclosure.

FIG. 7 is a timing diagram of the first stage illustrated in FIG. 5. An operation process of the first stage STGi will be described with reference to FIGS. 3 through 7. In the following embodiment, an embodiment in which the ith stage STGi outputs an ith scan signal Scani and ith emission control signal EMi on the basis of the first gate clock GCLK1 and the first emission clock ECLK1 will be described.

First, a process in which the scan signal generating unit outputs an ith scan signal Scani will be described.

The first gate clock GCLK1 is applied at a point in time at which the start signal VST is terminated. The first to seventh gate clocks GSLK1 to GCLK7 start to be output at an interval of 1 horizontal period 1H.

When both the start signal VST applied before an (n−2)th horizontal period [n−2]H and the seventh gate clock GCLK7 have voltages having a high level, the first and second transistors T1 and T2 connected in series receive the high potential voltage VDD and charge the received voltage in the first Q node Q1. That is, the first Q node is precharged at the time when the start signal VSS and the seventh gate clock GCLK7 are synchronized.

In a state in which the first Q node Q1 is precharged, a potential of a first electrode of a pull-up transistor T6 is increased when the first gate clock GCLK1 is provided through the input terminal of the first gate clock GCLK1. When the potential of the first electrode of the first pull-up transistor T106 is increased, a potential of a gate electrode thereof is bootstrapped and increased to maintain the potential of the first boosting capacitor C1. That is, a gate-source potential of the first pull-up transistor T6 is further increased by the potential provided to the first electrode in a state in which the gate electrode is precharged, so as to be turned on. The first pull-up transistor T6 outputs the first gate clock GCLK1 input through the first electrode to the scan signal output voltage n11.

When the first Q node A1 is charged, the eighth transistor T8 maintains the gate voltage of the first pull-down transistor T7 at a low potential voltage VSS. That is, the eighth transistor T8 prevents the scan signal output terminal n11 from being discharged while the first pull-up transistor T6 outputs a ith scan signal Scani.

The first gate clock GCLK1 maintains a high level during an initialization period Ti of the (n−2)th horizontal period n−2]H, a first sampling period Ts1 of the (n−1)th horizontal period [n−1]H, a second sampling period Ts2 of an nth horizontal period nH, and a data write period Tw.

After the first gate clock GCLK, the fourth gate clock GCLK4 starts to be applied at a start point of the (n+1)th horizontal period [n+1]H. When the fourth gate clock GCLK4 is provided, the fourth transistor T4 charges the first QB node QB1. When the first QB node QB1 is charged, the seventh transistor T7 is turned on to discharge the potential of the scan signal output terminal n11 to the low potential voltage VSS. As a result, when the first gate clock GCLK is terminated, the applied fourth gate clock GCLK stops output of the ith scan signal Scani output through the scan signal output terminal n11.

A process in which the emission control signal generating unit 140*b* outputs the ith emission control signal EMi will be described.

During an initialization period of the (i−2)th horizontal line ([n−2]HL, the (i−2)th scan signal Scan[i−2] and the third emission clock ECLK3 are synchronized. When the third emission clock ECLK3 and the (i−2)th scan signal Scan[i−2] are synchronized, the first low potential trigger transistor T11 charges the second QB node QB2, and thus, the 13$^{th}$ and 14$^{th}$ transistors T13 and T14 are turned on. The turned-on 13$^{th}$ and 14$^{th}$ transistors T13 and T14 discharge a potential of the emission control signal output terminal n12 to the low potential voltage VSS. That is, the emission control signal maintained at the high level during an emission period of a previous frame is reversed to a low level during the initialization period Ti[n−2] of the (i−2)th horizontal line.

After the initialization period Ti[n−2] of the (i−2)th horizontal line and before the first emission clock ECLK1 is input, the emission control signal output terminal n12 maintains the low potential voltage.

During the first sampling period Ts1, the ninth transistor T9 is turned on by the first emission clock ECLK1 to charge the second Q node Q2 and the second boosting capacitor C2. As the second Q node Q2 is charged, the second pull-up transistor T12 is turned on to output the high potential voltage VDD to the emission control signal output terminal n12.

During a first transition period Td1, the (i−1)th scan signal Scan[i−1] is synchronized with the emission reset ERST. When the (i−1)th scan signal Scan[i−1] is synchronized with the emission reset ERST, the second low potential trigger transistor T16 charges the second QB node QB2 to turn on the 13$^{th}$ and 14$^{th}$ transistors T13 and T14. The turned-on 13$^{th}$ and 14$^{th}$ transistors T13 and T14 discharge the potential of the emission control signal output terminal n12 to the low potential voltage VSS. That is, during the first transition period Td1, the emission control signal EMi is reversed to a low level again.

During the second sampling period Ts2, the ninth transistor T9 is turned on by the first emission clock ECLK1 to charge the second Q node Q2 and the second boosting capacitor C2. As the second Q node Q2 is charged, the second pull-up transistor T12 is turned on to output the high potential voltage VDD to the emission control signal output terminal n12.

During the second transition period Td2, the first scan signal Scani is synchronized with the emission reset ERST. When the first scan signal Scani is synchronized with the emission reset ERST, the third low potential trigger transistor T15 charges the second Q node QB2 to turn on the 13$^{th}$ and 14$^{th}$ transistors T13 and T14. The turned-on 13$^{th}$ and 14$^{th}$ transistors T13 and T14 discharge the potential of the emission control signal output terminal n12 to the low potential voltage VSS. That is, the emission control signal EMi is reversed to the low level again during the second transition period Td2.

During an emission period Te, the ninth transistor T9 is turned on by the first emission clock ECLK1 to charge the second Q node Q2 and the second capacitor C2. As the second Q node Q2 is charged, the second pull-up transistor T12 is turned on to output the high potential voltage VDD to the emission control signal output terminal n12. During the emission period T2, the second boosting capacitor C2 maintains a gate-source potential of the second pull-up transistor T12 to be equal to or higher than an operating voltage. Thus, the second pull-up transistor T12 may output the high potential voltage VDD to the emission control signal output terminal n12 during the emission period Te.

During the emission period Te, the 17$^{th}$ transistor T17 and the 19$^{th}$ transistor T19 are turned on upon receiving the second emission clock ECLK2 and the sixth emission clock ECLK6 at a predetermined interval, respectively. That is, during the emission period Te, the 17$^{th}$ transistor T17 and the 19$^{th}$ transistor T17 maintains the second QB node QB2 at the low potential voltage to restrain the 13$^{th}$ and 14$^{th}$ transistors T13 and T14 from being turned on. That is, the second and sixth emission clocks ECLK2 and ECLK6 allow the first emission control signal EM1 having a high potential to be stably output through the emission control signal output terminal n12 during the emission period Te.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting display device comprising:

a display panel including n number of horizontal lines in which organic light emitting diode (OLED) pixels are arranged, wherein n is a natural number;

an ith scan signal generating unit configured to generate a scan signal for scanning an ith horizontal line, and provide the ith scan signal to the ith horizontal line and an (i+2)th horizontal line, wherein i is a natural number satisfying a condition of $1 \leq i \leq n-2$; and an ith emission control signal generating unit configured to generate an ith emission control signal to be provided to the ith horizontal line, wherein the ith scan signal generating unit outputs the ith scan signal within a scan period of the ith horizontal line from an (i−2)th horizontal line, and wherein the ith emission control signal generating unit is synchronized with the ith scan signal within the scan period of a (i−1)th horizontal line and synchronized with the ith scan signal during a partial section within the scan period of the ith horizontal line.

2. The organic light emitting display device of claim 1, wherein the ith emission control signal generating unit comprises:

a pull-up transistor configured to output a high potential voltage to an emission control signal output terminal when a Q node is charged;

a pull-down transistor configured to discharge a potential of the emission control signal output terminal to a low potential voltage when a QB node is charged;

a first low potential trigger transistor configured to charge the QB node at an initialization stage of the (i−2)th horizontal line;

a second low potential trigger transistor configured to charge the QB node during a second sampling stage of the (i−1)th horizontal line; and a third low potential trigger transistor configured to charge the QB node during a data write stage of the first horizontal line.

3. The organic light emitting display device of claim 2, wherein a first electrode of the first low potential trigger transistor is connected to an output terminal of a (i−2)th scan signal generating unit, a second electrode thereof is connected to the QB node, and a gate electrode thereof is connected to an emission clock input terminal outputting a high level signal at an initialization stage of the (i−2)th horizontal line.

4. The organic light emitting display device of claim 2, wherein a gate electrode of the second low potential trigger transistor is connected to an output terminal of an (i−1)th scan signal generating unit, a first electrode thereof is connected to an emission reset input terminal outputting a high level signal during a second sampling stage of the (i−1)th horizontal line, and a second electrode thereof is connected to the QB node.

5. The organic light emitting display device of claim 4, wherein a gate electrode of the third low potential trigger transistor is connected to an output terminal of a (i−2)th scan signal generating unit, a first electrode thereof is connected to the emission reset input terminal, and a second electrode is connected to the QB node.

6. The organic light emitting display device of claim 1, wherein each of the pixels arranged in the ith horizontal line comprises:

a driving transistor configured to control a driving current provided to the OLED;

a first transistor configured to receive the emission control signal through the gate electrode, and having first and second electrodes connected to a high potential voltage source and a drain electrode of the driving transistor, respectively;

a second transistor configured to receive an (i−2)th scan signal through the gate electrode, and having first and second electrodes connected to an initialization line and a source electrode of the driving transistor, respectively; and a third transistor configured to receive an ith scan signal through the gate electrode, and having first and second electrodes connected to a data line and a gate electrode of the driving transistor, respectively.

* * * * *